US007112107B1

(12) United States Patent
Torgerud

(10) Patent No.: US 7,112,107 B1
(45) Date of Patent: Sep. 26, 2006

(54) THROTTLE CONTROL MECHANISM WITH HAPTIC FEEDBACK

(75) Inventor: Michael A. Torgerud, Mt. Calvary, WI (US)

(73) Assignee: Brunswick Corporation, Lake Forest, IL (US)

( * ) Notice: Subject to any disclaimer, the term of this patent is extended or adjusted under 35 U.S.C. 154(b) by 341 days.

(21) Appl. No.: 10/771,927

(22) Filed: Feb. 4, 2004

(51) Int. Cl.
*B63H 21/21* (2006.01)

(52) U.S. Cl. ..... 440/2; 440/84; 440/87

(58) Field of Classification Search ..... 440/2, 440/84, 86, 87; 74/480 B
See application file for complete search history.

(56) References Cited

U.S. PATENT DOCUMENTS 3,786,628 A * 1/1974 Fossard et al. ..... 368/12
3,860,838 A * 1/1975 Kumon ..... 310/322
4,982,918 A 1/1991 Kaye
5,481,261 A * 1/1996 Kanno ..... 340/870.16
6,091,321 A 7/2000 Karell
6,116,971 A * 9/2000 Morikami ..... 440/2
6,377,879 B1 * 4/2002 Kanno ..... 701/29
6,904,823 B1 * 6/2005 Levin et al. ..... 74/471 XY
2002/0142701 A1 * 10/2002 Rosenberg ..... 446/454
2004/0147318 A1 * 7/2004 Shahoian et al. ..... 463/36
2005/0056253 A1 * 3/2005 Yone et al. ..... 123/399

OTHER PUBLICATIONS

U.S. Appl. No. 09/804,486, filed Mar. 12, 2001, Aaltonen et al.
U.S. Appl. No. 10/116,237, filed Apr. 3, 2002, Levin et al.
U.S. Appl. No. 10/276,571, May 19, 2001, Wafzig.
"Introduction: What is force feedback devices?", (Internet Website: http;//ldt.stanford.edu/-yasukato/portfolio/class/cs147/as8/).
"Piezoceramic Devices", (Internet Website: http://www.fdk.co.jp/cyber-e/se18-e/se18-e.html).
"Force Feedback Joystick as a low cost haptic interface for an atomic force microscopy nanomanipulator", by Francisco J. Rubio-Sierra, et al., pp. 1-14.
"6CL-0848A", (Internet Website: http://www.vibratormotor.com/6CL-0848A.html).

* cited by examiner

*Primary Examiner*—Sherman Basinger
(74) *Attorney, Agent, or Firm*—William D. Lanyi

(57) ABSTRACT

A haptic throttle control mechanism includes a vibrating element that is connected in vibration transmitting relation with the control mechanism. The vibrating element can be a motor with an eccentric weight attached to its shaft or a piezoceramic component. The vibrating signal can be used to provide information to the operator of the marine vessel relating to the actual operating speed of the engine or, alternatively, it can be used to alert the operator of an alarm condition.

20 Claims, 3 Drawing Sheets

THROTTLE CONTROL MECHANISM WITH HAPTIC FEEDBACK

BACKGROUND OF THE INVENTION

1. Field of the Invention

The present invention is generally related to a throttle control mechanism for a marine propulsion system and, more particularly, to a haptic feedback system that provides a vibratory signal that is intended to convey information to the operator of a marine vessel concerning and operating characteristic of an engine of the marine propulsion system.

2. Description of the Prior Art

Many different types of throttle control mechanisms are well known to those skilled in the art of marine propulsion systems. Typically, an operator controlled movable throttle handle is pivotally attached to a housing structure to allow the handle to be rotated about an axis by the operator of a marine vessel in order to cause the propulsion system to select either a forward or reverse gear position and to command a speed signal to a controller of the engine.

U.S. Pat. No. 6,091,321, which issued to Karell on Jul. 18, 2000, describes a method and apparatus for a vibratory indicator for use in vehicles. The device is intended to alert a driver by use of vibratory indicator, which may be located within a seat or on a driver's person. An example is an uncancelled turn signal indicator which senses that the turn signal indicator has been selected for more than an appropriate period of activation and upon sensing this condition, the driver's seat vibrates alerting the driver of the presence of this condition. Other indicators within vehicles use vibratory means to alert the driver. The vibratory indicator may be used as a back-up to audible or visual indicators.

U.S. patent application Ser. No. 09/804,486, which was filed by Aaltonen et al. on Sep. 12, 2002, describes a mobile phone featuring audio-modulated vibrotactile module. A telecommunications network includes a mobile phone with an audio-modulated vibrotactile module that responds to a telecommunications signal containing information about incoming speech from a called/calling party, for providing an audio-modulated vibrotactile module force containing information about the incoming speech from the called/calling party to vibrate a user's fingers, facial skin, wrist, cheek or other suitable location. The audio-modulated vibrotactile module has an audio-to-vibrotactile converter that responds to the telecommunications signal, for providing an audio-to-vibrotactile converter signal containing information about a vibration modulation of the incoming speech from the called/calling party.

U.S. Pat. No. 4,982,918, which issued to Kaye on Jan. 8, 1991, describes a force sensitive aircraft throttle with feedback. A force controlled throttle suitable for military or civil aircraft is described which is stowable in a console when not required for use. Fore and aft forces applied to the throttle handle by the pilot are sensed by pressure transducers which generate, in response, signals for controlling engine thrust. Tactile information relating to engine thrust demand is fed back to the pilot by means of a drive motor which tilts the throttle handle as fore or aft pressure is exerted. The angle of tilt is a function of the degree of pressure exerted and the demanded engine thrust.

U.S. patent application Ser. No. 10/116,237, which was filed by Levin et al. on Apr. 3, 2002, describes a haptic shifting device. The device is intended for use in shift-by-wire systems in vehicles. The haptic shift device includes a shift lever includes a shift lever manipulatable by a user. At least one sensor detects a position of the shift lever, and a transmission gear of the vehicle is caused to be changed based on the position of the shift lever. At least one electrically-controlled actuator outputs a force on the shift lever in some embodiments, the shift lever is movable within a pattern and is blocked from areas outside the boundaries of the pattern. The actuators can be active or passive, and/or a variable mechanical gate can be used to implement the pattern. Provided shifting modes can include automatic, manual, and/or sequential modes. Other shifting modes can also be provided.

U.S. patent application Ser. No. 10/276,571, which was filed by Wafzig on May 19, 2001, describes a method and device for issuing a feedback signal to the driver of a motor vehicle. A method and device are described for issuing a feedback signal to the driver of a motor vehicle as soon as an admissible constant load limit of a shifting element in a motor vehicle transmission, especially a starting clutch in an automatic transmission, is exceeded. The feedback signal to the driver takes the form of a haptic signal via an accelerator pedal of the motor vehicle as pulsated motion of the throttle pedal.

The patents described above are hereby expressly incorporated by reference in the description of the present invention.

Force feedback devices are known for use in association with various types of video games. An article relating to these applications, titled "Introduction: What Is Force Feedback Devices?", describes various applications that can be used in conjunction with different types of video games.

An article titled "Piezoceramic Buzzers" describes various features, applications and test conditions relating to piezoceramic components.

An article titled "Force Feedback Joystick as a low cost haptic interface for an atomic force microscopy nanomanipulator" by Rubio-Sierra et al., describes another application of this technology.

A technical article relating to miniature vibrating motors is provided by VibratorMotor.com. The specifications of this type of motor are provided in detail, including dimensions.

It is generally known to those skilled in the art that vibration can be caused in several ways. A motor can be provided with an unbalanced weight attached to its shaft. A piezoceramic component can be excited to produce a vibration at a preselected frequency. These types of components are used in cell phones, joy sticks for video games, and other applications where either a vibratory feeling or sound vibrations are used.

In marine vessels, it has been a goal for many years to provide marine propulsion systems with engines that operate very quietly in order to enhance the enjoyment of using a marine vessel. If the engine is operating quietly and at a sufficient distance from the operator of a marine vessel, the operator may not be able to instantly detect when the engine stalls or fails to operate properly. An alarm message can be transmitted to a visual screen display or annunciator, but this may not be immediately noticed by the operator of the marine vessel. It would therefore be significantly beneficial if some method or apparatus could be provided so that the operator of the marine vessel could easily monitor the operating condition of the engine in the marine propulsion system.

SUMMARY OF THE INVENTION

A haptic throttle control mechanism for a marine propulsion system, made in accordance with a preferred embodiment of the present invention, comprises an operator controlled movable device and a marine propulsion unit connected in signal communication with the operator controlled movable device. Although the haptic throttle control mechanism will be described below in terms of a handle, it should be clearly understood that the present invention can also be used in conjunction with a haptic throttle control mechanism which is a foot pedal. The operator controlled movable device is configured to provide a signal to the marine propulsion unit. The marine propulsion unit comprises an engine and the signal is generally related to a commanded engine speed. A vibrating element is connected in vibration transmitting relation with the operator controlled movable device. The vibrating element is configured to vibrate in a manner which is generally representative of an operating characteristic of the marine propulsion system.

The operator controlled movable device is a throttle control mechanism in a particularly preferred embodiment of the present invention. The throttle control mechanism is pivotable about an axis. A range of travel of the throttle control mechanism includes a forward speed segment and a reverse speed segment. An angular distance of the throttle control mechanism from a central position is representative of the commanded engine speed. The vibrating element is configured to vibrate at a frequency which is representative of the actual engine speed. The vibrating element can be configured to vibrate at a frequency which is directly proportional to the actual engine speed. Alternatively, the vibrating element can be configured to vibrate at a frequency which is representative of an alarm condition relating to the engine.

The vibrating element can comprise a rotating component which is attached to a shaft of an electric motor. The electric motor can be a DC motor and the rotating component can be an unbalanced eccentric object which is configured to create vibrations when rotated about an axis which is not aligned with a center of gravity of the object.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
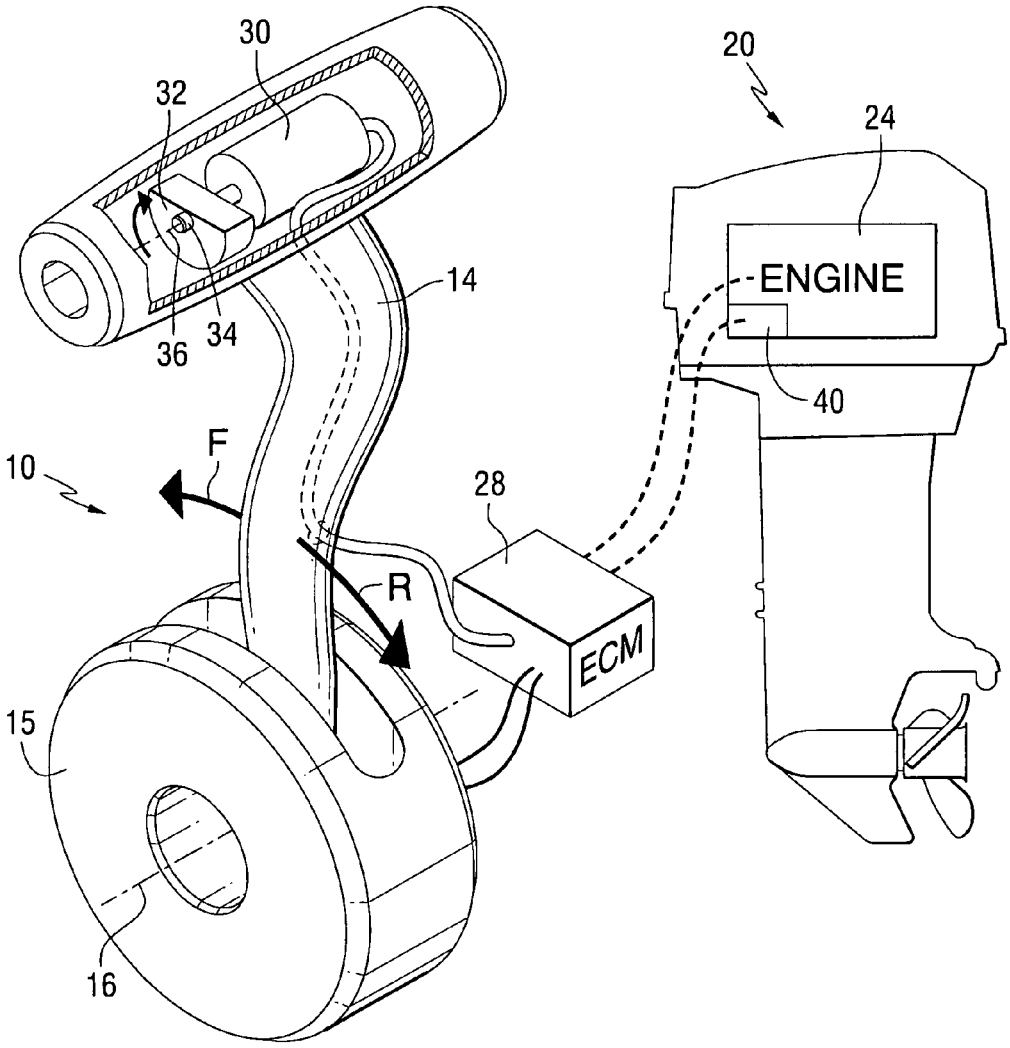
FIG. 1 is an isometric representation of the present invention with a motor used as the vibrating element.

Throughout the description of the preferred embodiment of the present invention, like components will be identified by like reference numerals.

FIG. 1 is a simplified isometric representation of the present invention. It should be understood that the components shown in FIG. 1 are not drawn to scale. An operator controlled movable device 10, such as a throttle handle 14, is shown associated with a housing structure 15, and configured to be pivotable about an axis 16. The throttle handle 14 is movable in a forward direction, represented by Arrow F, or in a reverse direction, represented by Arrow R. A marine propulsion unit 20, such as an outboard motor, comprises an engine 24. Movement of the operator controlled movable device 10 provides a signal to the engine 24 that is related to a commanded engine speed. In a typical embodiment, a transducer is provided in the housing 14 which provides a signal to the engine control module (ECM) 28 which, in turn, provides a signal for the engine 24 that determines a commanded engine speed. As is generally well known to those skilled in the art, this signal can be used to determine fueling rates, throttle positions, ignition timing, and other variables that can be used to select and determine the operating speed of the engine 24.

A vibrating element 30 is connected in vibration transmitting relation with the operator controlled movable device 10. In FIG. 1, the vibrating element 30 is a DC motor with a rotating component 32 attached to a shaft 34 of the motor 30. The rotating component 32, as illustrated in FIG. 1, is an unbalanced eccentric object configured to create vibrations when rotated about an axis 36 that is not aligned with a center of gravity of the object 32. The rotation of the unbalanced eccentric object 32 about axis 36 will therefore create a vibration in the throttle control mechanism 14 at a frequency which is dependent on the rotational speed of the rotor of the DC motor 30. This vibration will be transmitted to the throttle control mechanism 14 and can be sensed by the operator of the marine vessel when that operator is gripping the handle. A tachometer 40 can be provided to measure the actual operating speed of the engine 24.

With continued reference to FIG. 1, the operator of the marine vessel can move the throttle control mechanism 14 about axis 16 to command the marine propulsion system to select either forward or reverse gear and, by moving the control mechanism 14 away from a central position, the distance of the handle 14 from that central position can provide a signal to the engine control module 28 which selects a commanded operating speed for the engine 24. The tachometer 40 measures the actual operating speed of the engine 24 and provides a signal, through the engine control module 28, to the vibrating element 30 which causes the vibrating element 30 to rotate and create a vibration at a frequency which is selected to convey information relating to the operating condition, such as operating speed, of the engine. If a DC motor is used, the voltage provided to the motor can determine the rotational speed of the motor's rotor. This, in turn, determines the frequency of vibration caused by the rotation of the unbalanced eccentric object 32. In this way, the operator of the marine vessel can sense the frequency of the vibration in the handle 14 and determine the approximate operating speed of the engine 24. If the engine 24 is not operating at the commanded speed, the operator of the marine vessel can sense this. This is particularly useful if the engine stalls. Under these conditions, the operator who is commanding a specific speed will sense that the engine is not operating at any speed and quickly determine the stalled condition of the engine.

Figure 2:
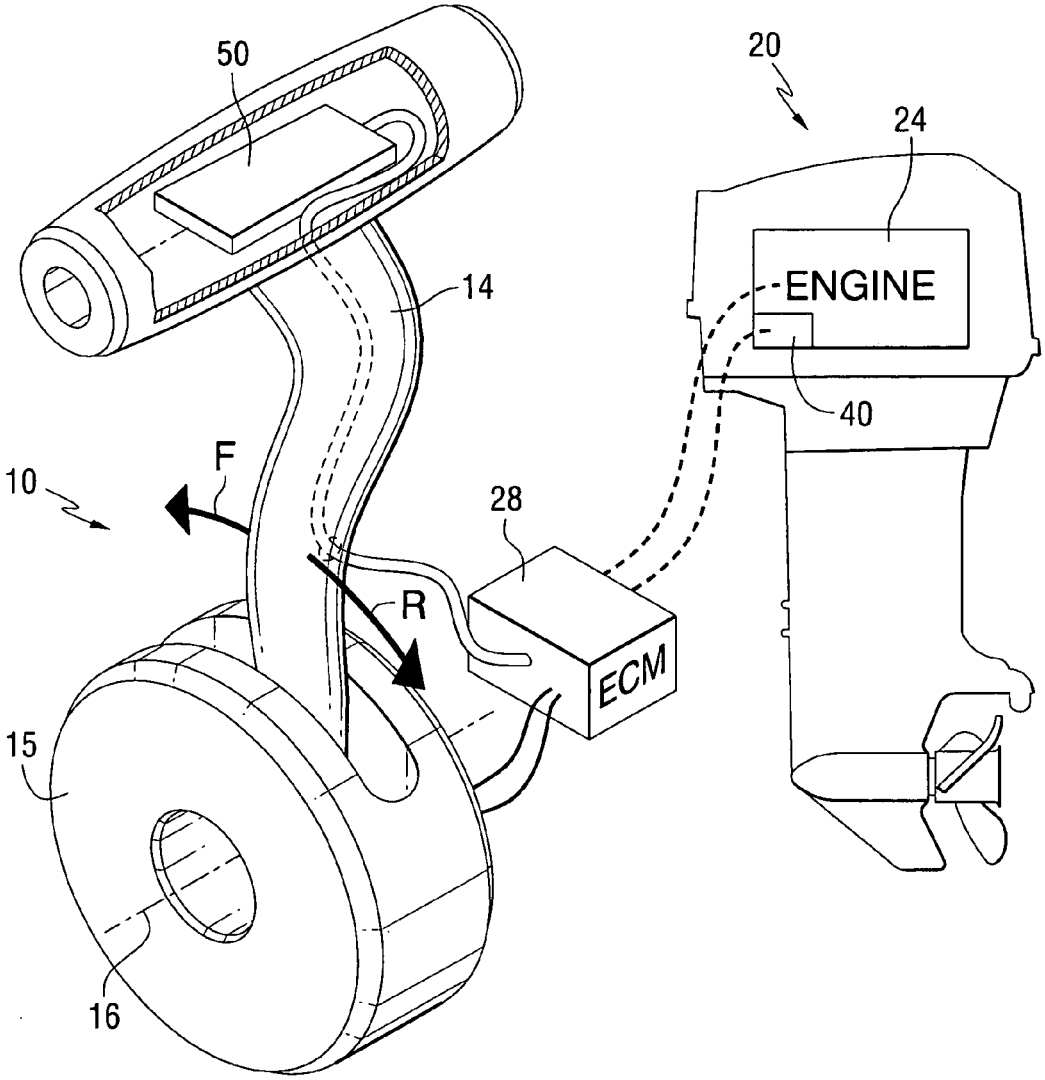
FIG. 2 is similar to FIG. 1 but with a piezoceramic component used as the vibrating element.

FIG. 2 is similar to FIG. 1, but the vibrating element comprises a piezoceramic component 50. The basic operation of the embodiment shown in FIG. 2 is similar to that described above in conjunction with FIG. 1, but no motor 30 or unbalanced eccentric object 32 is used. Instead, the piezoceramic component is excited by the voltage provided to it and vibrates. The technology of piezoceramics is well known to those skilled in the art and has been used in various applications to provide a tactile signal that is sensible by a human being. These same components can also be used to provide an audio signal.

Figure 3:
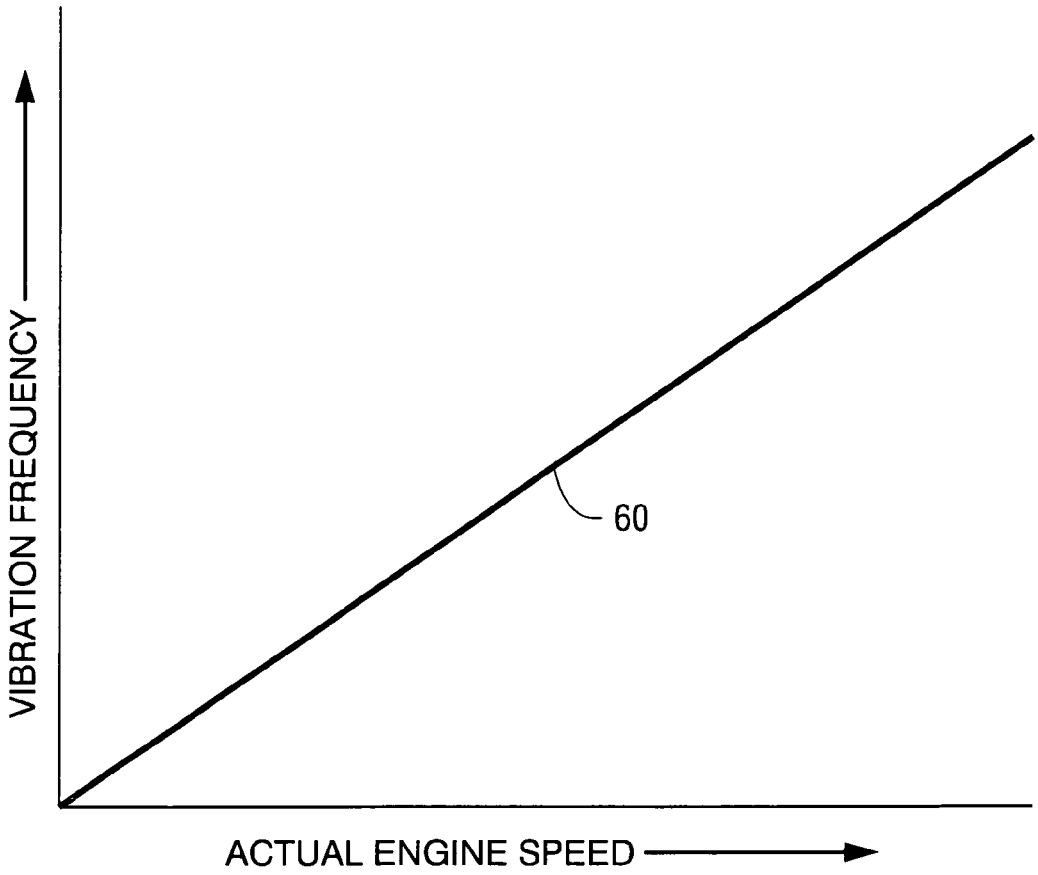
FIG. 3 is a graphical representation of a relationship between a vibration frequency of the vibrating element and an actual engine speed.

FIG. 3 is a graphical representation that illustrates the relationship between the vibration frequency of the vibrating component, such as the motor 30 or the piezoceramic component 50, as a function of the actual engine speed. In FIG. 3, line 60 represents this relationship as being a generally linear function with the vibration frequency to have a magnitude which is directly proportional to the actual engine speed. It should be understood that this direct proportionality and linearity is not a requirement in all embodiments of the present invention.

It should also be understood that the vibration of the vibrating element can be used in a slightly different way than that described above. Instead of providing a signal whose frequency varies as a function of a varying characteristic, such as engine operating speed, the vibrating signal can be used as an alert medium by which to inform the operator of an alarm condition. In other words, if the engine stalls, a short burst of vibrations can be used to inform the operator of this stalled condition. Alternatively, a series of bursts separated by inactivity by the vibrating element can be used for this same purpose. This type of application of the present invention is slightly different than that described above where the frequency of the vibrating element is generally used to distinguish various operating speeds of the engine even though the vibration itself is generally continuous as long as the engine is operating at some speed. In the alarm notification mode of the present invention, no vibration is provided until an alarm condition exists.

With reference to FIGS. 1–3, the haptic throttle control mechanism 14 for a marine propulsion system comprises a operator controlled movable device and a marine propulsion unit 20 that is connected in signal communication with the operator controlled movable device 10. The operator controlled movable device is configured to provide a signal to the marine propulsion unit, typically through an engine control module 28, and the marine propulsion unit comprises an engine 24. The signal which is provided as a function of the rotational or pivotal position of the control mechanism 14 about axis 16, is generally related to a commanded engine speed. It can also provide information regarding a commanded forward or reverse gear position. A vibrating element, such as a motor with an eccentric weight or a piezoceramic component, is connected in vibration transmitting relation with the operator controlled movable device 10 and, more particularly, with the throttle control mechanism 14. The vibrating element is configured to vibrate in a manner which is generally representative of an operating characteristic of the marine propulsion system, such as an operating speed of the engine 24. The operator controlled movable device 10 can be a throttle handle for a marine propulsion system which is pivotable about an axis 16. A range of travel of the throttle handle 14 includes a forward speed segment F and a reverse speed segment R. An angular distance of the throttle handle 14 from a central position is representative of the commanded engine speed. An engine speed monitoring device, such as a tachometer 40, has an output speed signal which is representative of the actual engine speed. The vibrating element is configured to vibrate at a frequency which is representative of the actual engine speed. The vibrating element is configured to vibrate at a frequency which is directly proportional to the actual engine speed and, in certain applications, at a frequency which is representative of an alarm condition relating to the engine. The vibrating element can comprise a rotating component which is attached to a shaft of an electric motor, such as a DC motor. The rotating component can be an unbalanced eccentric object configured to create vibrations when it is rotated about an axis which is not aligned with the center of gravity of the object or, alternatively, it can be a piezoceramic component.

Although the present invention has been described with particular specificity and illustrated to show two particularly preferred embodiments, it should be understood that alternative embodiments are also within its scope.

I claim:

1. A haptic throttle control mechanism for a marine propulsion system, comprising:

an operator controlled movable device;

a marine propulsion unit connected in signal communication with said operator controlled movable device, said operator controlled movable device being configured to provide a signal to said marine propulsion unit, said marine propulsion unit comprising an engine, said signal being generally related to a commanded engine speed; and a vibrating element connected in vibration transmitting relation to said operator controlled movable device, said vibrating element being configured to cause said operator controlled movable device to vibrate in a manner which is generally representative of an operating characteristic of said marine propulsion system and which is tactilely sensible to an operator of said marine propulsion device.

2. The throttle control mechanism of claim 1, wherein:

said operator controlled movable device is a throttle control mechanism which is pivotable about an axis.

3. The throttle control mechanism of claim 2, wherein:

a range of travel of said throttle control mechanism includes a forward speed segment and a reverse speed segment.

4. The throttle control mechanism of claim 2, wherein:

an angular distance of said throttle control mechanism from a central position is representative of said commanded engine speed.

5. The throttle control mechanism of claim 1, further comprising:

an engine speed monitoring device having an output speed signal which is representative of an actual engine speed.

6. The throttle control mechanism of claim 5, wherein:

said vibrating element is configured to vibrate at a frequency which is representative of said actual engine speed.

7. The throttle control mechanism of claim 6, wherein:

said vibrating element is configured to vibrate at a frequency which is directly proportional to said actual engine speed.

8. The throttle control mechanism of claim 1, wherein:

said vibrating element is configured to vibrate at a frequency which is representative of an alarm condition.

9. The throttle control mechanism of claim 1, wherein:

said vibrating element comprises a rotating component attached to a shaft of an electric motor.

10. The throttle control mechanism of claim 9, wherein:

said rotating component is an unbalanced eccentric object configured to create vibrations when rotated about an axis which is not aligned with a center of gravity of said object.

11. The throttle control mechanism of claim 1, wherein:

said vibrating element comprises a piezoelectric component.

12. A haptic throttle-control mechanism for a marine propulsion system, comprising:

an operator controlled movable throttle control mechanism;

a marine propulsion unit connected in signal communication with said operator controlled movable throttle control mechanism, said operator controlled movable throttle control mechanism being configured to provide a signal to said marine propulsion unit, said marine propulsion unit comprising an engine, said signal being generally related to a commanded engine speed, a range of travel of said operator controlled movable throttle control mechanism comprising a forward speed segment and a reverse speed segment;

a vibrating element connected in vibration transmitting relation with said operator controlled movable throttle control mechanism, said vibrating element being configured to cause said operator controlled movable device to vibrate in a manner which is generally representative of an operating characteristic of said marine propulsion system and which is tactilely sensible to an operator of said marine propulsion device.

13. The throttle control mechanism of claim 12, wherein:

an angular distance of said throttle control mechanism from a central position is representative of said commanded engine speed.

14. The throttle control mechanism of claim 13, further comprising:

an engine speed monitoring device having an output speed signal which is representative of an actual engine speed.

15. The throttle control mechanism of claim 14, wherein:

said vibrating element is configured to vibrate at a frequency which is representative of said actual engine speed.

16. The throttle control mechanism of claim 15, wherein:

said vibrating element is configured to vibrate at a frequency which is directly proportional to said actual engine speed.

17. The throttle control mechanism of claim 14, wherein:

said vibrating element is configured to vibrate at a frequency which is representative of an alarm condition.

18. The throttle control mechanism of claim 14, wherein:

said vibrating element comprises a rotating component attached to a shaft of an electric motor.

19. A haptic throttle control mechanism for a marine propulsion system, comprising:

an operator controlled movable throttle control mechanism;

a marine propulsion unit connected in signal communication with said operator controlled movable throttle control mechanism, said operator controlled movable throttle control mechanism being configured to provide a signal to said marine propulsion unit, said marine propulsion unit comprising an engine, said signal being generally related to a commanded engine speed, a range of travel of said operator controlled movable throttle control mechanism comprising a forward speed segment and a reverse speed segment, an angular distance of said throttle control mechanism from a central position being representative of said commanded engine speed;

a vibrating element attached in vibration transmitting relation with said operator controlled movable throttle control mechanism, said vibrating element being configured to cause said operator controlled movable device to vibrate in a manner which is generally representative of an operating characteristic of said marine propulsion system and which is tactilely sensible to an operator of said marine propulsion device, said vibrating element comprising a rotating component attached to a shaft of an electric motor; and an engine speed monitoring device having an output speed signal which is representative of an actual engine speed.

20. The throttle control mechanism of claim 19, wherein:

said vibrating element is configured to vibrate at a frequency which is representative of said actual engine speed.

* * * * *